US007040780B2

(12) United States Patent
Diehl

(10) Patent No.: US 7,040,780 B2
(45) Date of Patent: May 9, 2006

(54) LASER DAZZLER MATRIX

(75) Inventor: Matthew D. Diehl, St. Albans, VT (US)

(73) Assignee: General Dynamics Armament And Technical products, Burlington, VT (US)

( * ) Notice: Subject to any disclaimer, the term of this patent is extended or adjusted under 35 U.S.C. 154(b) by 166 days.

(21) Appl. No.: 10/781,630

(22) Filed: Feb. 20, 2004

(65) Prior Publication Data

US 2005/0185403 A1 Aug. 25, 2005

(51) Int. Cl.
*G02B 27/20* (2006.01)
*F21L 4/02* (2006.01)
*F21V 23/04* (2006.01)

(52) U.S. Cl. ..... 362/259; 362/86; 362/234; 362/251

(58) Field of Classification Search ..... 362/259, 362/86, 234
See application file for complete search history.

(56) References Cited

U.S. PATENT DOCUMENTS

| | | | | |
|---|---|---|---|---|
| 4,523,809 | A | 6/1985 | Taboada et al. | 359/577 |
| 4,963,798 | A | 10/1990 | McDermott | 315/312 |
| 5,060,237 | A | 10/1991 | Peterson | 372/50.12 |
| 5,351,259 | A | 9/1994 | Ishimori et al. | 372/75 |
| 5,734,504 | A | 3/1998 | Billman | 359/618 |
| 5,836,081 | A * | 11/1998 | Orosz, Jr. | 362/259 |
| 5,859,915 | A | 1/1999 | Norris | 381/75 |
| 6,007,219 | A | 12/1999 | O'Meara | 362/259 |
| 6,102,552 | A * | 8/2000 | Tullis | 362/249 |
| 6,142,650 | A | 11/2000 | Brown et al. | 362/259 |
| 6,150,943 | A * | 11/2000 | Lehman et al. | 362/259 |
| 6,190,022 | B1 | 2/2001 | Tocci et al. | 362/259 |
| 6,431,732 | B1 | 8/2002 | Brown et al. | 362/259 |
| 6,722,771 | B1 * | 4/2004 | Stephens | 362/231 |
| 6,774,893 | B1 * | 8/2004 | Debiez et al. | 362/227 |
| 2003/0123254 | A1 * | 7/2003 | Brass et al. | 362/259 |
| 2004/0165380 | A1 * | 8/2004 | Chew | 362/235 |

OTHER PUBLICATIONS

Article—Author(s): Richard Dennis; James Harrison; Wallace Mitchell; Douglas Apsey, Steven Cora and John Williams—Title: "Visual Effects Assessment of the Green Laser-Baton Illuminator (GLBI)"—Date: Aug. 7, 2001; 16 pp, Document No. 189571.

(Continued)

*Primary Examiner*—Alan Cariaso
(74) *Attorney, Agent, or Firm*—Hunton & Williams

(57) ABSTRACT

A non-lethal laser weapon having a base to which a number of lasers are mounted. The lasers include a first laser oriented to project a first laser beam in a first direction, and a second laser oriented to project a second laser beam generally in the first direction. The first laser beam and the second laser beam overlap at a first distance from the base, to thereby form separate first and second first-order illumination zones before the first distance, and a first second-order illumination zone beyond the first distance. Additional lasers may be included in one-, two-, and three-dimensional patterns to create additional illumination zones.

22 Claims, 11 Drawing Sheets

OTHER PUBLICATIONS

Internet Web Page: http://radsafe.berkeley.edu/1sts1101c.html, printed Dec. 23, 2003, (no author, "Section 2: The Unique Nature of Laser Radiation", no date, 1 page).
Internet Web Page: http://radsafe.berkeley.edu/1sts11013.html, printed Dec. 23, 2003, (no author, "Section 4: Laser Radiation Bioeffects", no date, 2 pp).
Internet Web Page: http://www.mic-d.com/curriculum/lightandcolor/lasers.html, printed Dec. 23, 2003, (no author, "OLYMPUS MIC-D: Physics of Light and Color", no date, 13 pp).
Internet Web Page: http://www.micro.magnet.fsu.edu/primer/java/lasers/diodelasers/, printed Dec. 23, 2003, (no author, "Molecular Expression: Physics of Light and Color—Diode Lasers: Interactive Java Tutorial", no date, 7 pp).
Article—Author: Wesley J. Marshall—Title: "Laser Source Size as a Function of Distance", no date, 2 pp.
Article—Author: Alexander Litvak—Title: "Laser Safety Guidelines", Apr. 2003, 10 pp.

* cited by examiner

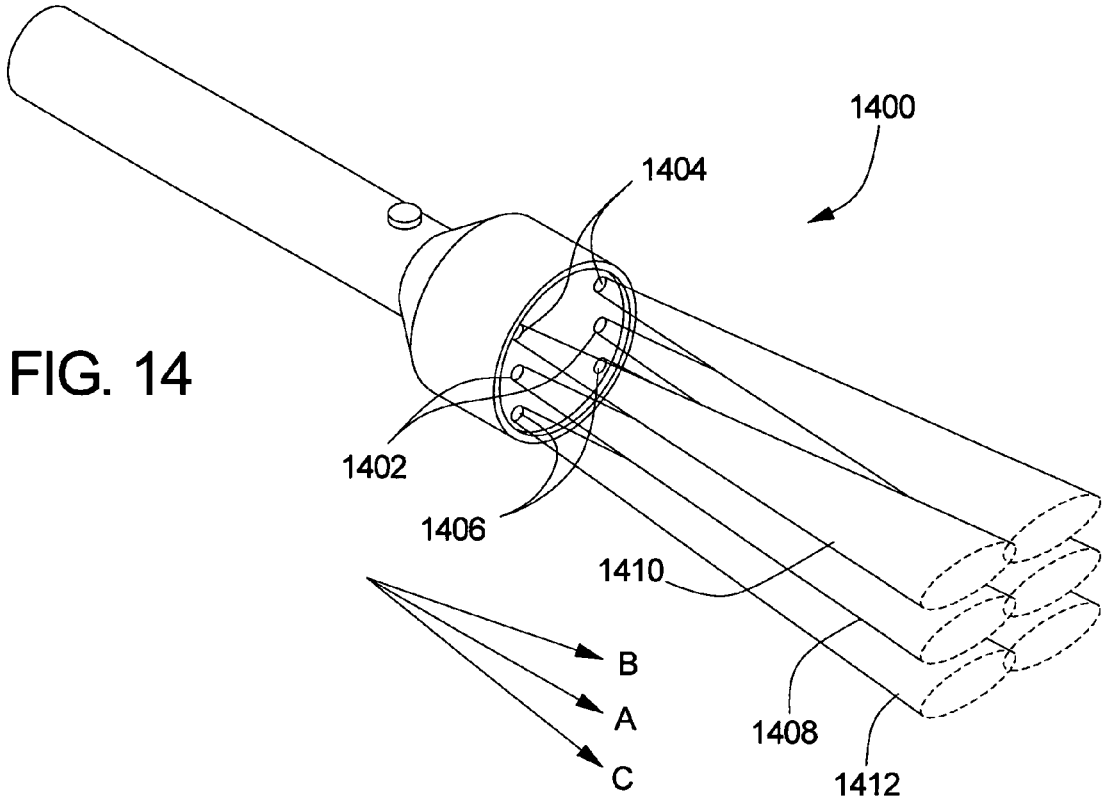
FIG. 14
FIG. 15
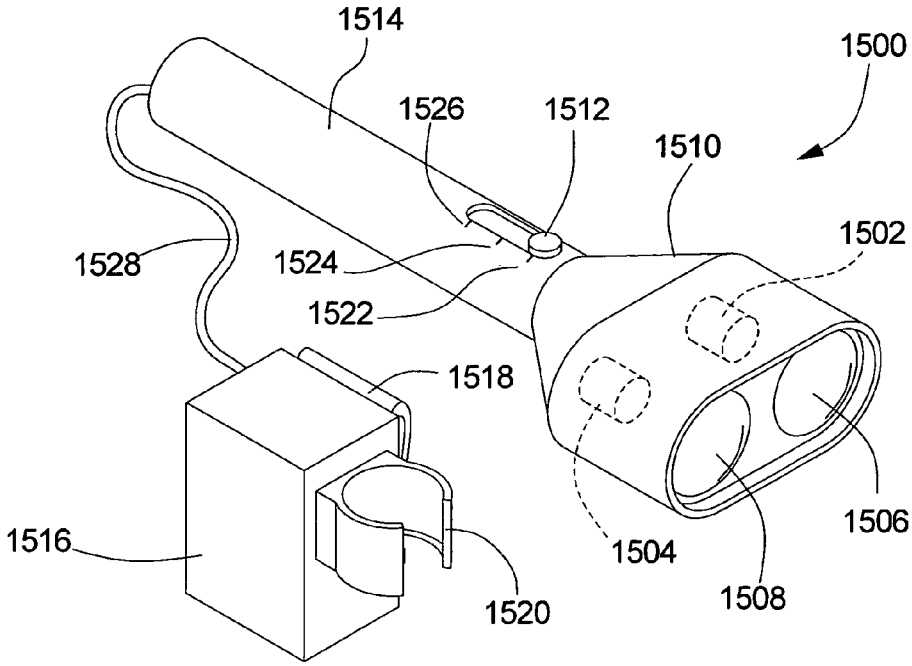

LASER DAZZLER MATRIX

CROSS-REFERENCE TO RELATED APPLICATIONS

Not applicable

BACKGROUND OF THE INVENTION

1. Field of the Invention

The present invention relates generally to laser systems and more particularly to non-lethal laser weapon systems for dazzling or stunning humans.

2. Description of Related Art

In recent years, military, security and police forces have placed an increasing emphasis on using non-lethal threat deterrence systems to neutralize threats without causing permanent injury to the target being suppressed. Such devices are desirable in a number of circumstances, such as when apprehending violent but unarmed subjects, for crowd control, during cell extractions, and when deadly force poses a risk to innocent bystanders or is otherwise unwarranted by the threat level. Examples of non-lethal weapons include high-voltage "taser" stun guns and chemical irritants such as pepper spray, tear gas, and the like.

It has also been recognized that high-intensity light sources have some threat-deterrence capability. For example, high-intensity light can present a glare that degrades vision, makes it difficult to see the direction of the light source, and causes discomfort while in the visual field of the observer. High-intensity light can also momentarily blind ("flashblind") the viewer, causing a significant effect on the retinal adaptation level resulting in a loss of visual sensitivity after the light source is removed, and can even promote physiological responses such as disorientation and nausea. The intensity and wavelength of the light, as well as the use of pulsed light, flashing and/or color-changing lights can all influence how the viewer is affected by the light. Generally speaking, these useful deterrent effects are referred to herein as "dazzling" effects.

Lasers, which provide an intense coherent beam of light, have been found to be particularly useful as a high-energy light source that can be used to daze or temporarily blind a subject. However, excessive exposure to laser radiation can cause permanent eye damage and blindness. As such, non-lethal weapons that use laser light sources must strike a balance between being intense enough to obtain the desired dazzling effects, and not being so intense that they cause permanent eye damage to the target.

The American National Standards Institute (ANSI) has developed laser safety guidelines (ANSI Z136.1-1993) that set forth the maximum permissible exposure to laser radiation to prevent permanent eye damage. In general terms, the maximum level of exposure is a function of the laser wavelength, the irradiance (also called the intensity or power density) at the location of the eye, which is typically measured as watts per square centimeter ($W/cm^2$), and the duration of the exposure. For purposes of calculating the exposure duration one typically assumes that the exposure duration is equal to the human blink response, which is about 0.250 seconds.

Based on these principles, a number of non-lethal laser weapon systems have been developed for use in self-defense, crowd control and other threat-deterrence situations. Examples of such devices are shown in U.S. Pat. Nos. 6,142,650 and 6,431,732 to Brown et al. and U.S. Pat. No. 6,190,022 to Tocci et al., which are incorporated herein by reference. These hand-held devices generally focus one or more lasers or high-intensity diode lasers or lights into a single collimated light source, and incorporate this light source into a conventional flashlight-like structure. These devices suffer from a significant drawback in that the collimated light beam must diverge rapidly to prevent it from being too intense at short distances, which has the result of making the device effective only over relatively short distances. Other performance aspects and drawbacks of such devices are discussed in Air Force Research Laboratory Report Number AFRL-HE-BR-TR-2001-0095, dated May, 2001 and titled "Visual Effects Assessment of the Green Laser-Baton Illuminator (GLBI)," which is incorporated herein by reference.

Therefore, an objective of the present invention is to provide an improved laser dazzling system that provides effective long- and short-range dazzling effects. Although certain deficiencies in the related art are described in this background discussion and elsewhere, it will be understood that these deficiencies were not necessarily heretofore recognized or known as deficiencies. Furthermore, it will be understood that, to the extent that one or more of the deficiencies described herein may be found in an embodiment of the claimed invention, the presence of such deficiencies does not detract from the novelty or non-obviousness of the invention or remove the embodiment from the scope of the claimed invention.

SUMMARY OF THE INVENTION

In a first embodiment, the present invention provides a non-lethal laser weapon having a base to which a plurality of lasers are mounted in a line, a triangle, a circle, or in other patterns. The plurality of lasers comprises a first laser oriented to project a first laser beam in a first direction, and a second laser oriented to project a second laser beam in the first direction. The first laser beam and the second laser beam overlap at a first distance from the base, to thereby form separate first and second first-order illumination zones before the first distance, and a first second-order illumination zone beyond the first distance.

In various embodiments, at least one of the plurality of lasers has a wavelength of about 400 nm to about 700 nm, or about 532 nm, or about 650 nm. One or more of the lasers also may be a separately collimated laser.

The device may also include a power supply and a power switch system connecting the power supply to the plurality of lasers. The power switch system is adapted to selectively energize the plurality of lasers. In such an embodiment, the plurality of lasers may comprise two or more laser groups, each of which has one or more lasers, and the power switch system may be adapted to selectively energize each of the two or more laser groups independently of the other laser groups. The power switch system also may comprise two-position switches, multi-position switches, or a combination thereof. The power supply may be integrated into the base or attached to the base by one or more electrical wires.

In various embodiments, the non-lethal laser weapon may be a portable hand-held device, or may be movably mounted to a fixed or portable mounting platform. The device also may include a high intensity directed acoustical device, a low-intensity targeting laser, and/or an incandescent lamp attached to the base and aimed generally parallel to the first direction.

In still other embodiments, the non-lethal laser weapon further includes a third laser oriented to project a third laser beam in the first direction. In this embodiment, the third laser beam overlaps the first laser beam at a second distance from the base and overlaps the first laser beam and the second laser beam at a third distance from the base, to thereby form a third first-order illumination zone before the second distance, a second second-order illumination zone between the second distance and the third distance, and a first third-order illumination zone beyond the third distance. In this embodiment, the first distance may equal the second distance. Also in this embodiment, the third laser beam may overlap the second laser beam at the second distance from the base to thereby form a third second-order illumination zone between the second distance and the third distance.

In still another embodiment, the plurality of lasers further includes a third laser oriented to project a third laser beam in a second direction, and a fourth laser oriented to project a fourth laser beam in the second direction. In this embodiment, the third laser beam and the fourth laser beam overlap at a second distance from the base, to thereby form separate third and fourth first-order illumination zones before the second distance, and a second second-order illumination zone beyond the second distance. The second direction may be substantially parallel to the first direction, or it may diverge from or converge with the first direction.

The present invention will be better understood from the following detailed description of the invention, read in connection with the drawings as hereinafter described.

BRIEF DESCRIPTION OF THE DRAWINGS

FIGS. 13–15 are embodiments of hand-held laser systems of the present invention.

DETAILED DESCRIPTION OF PREFERRED EMBODIMENTS

The present invention provides a multi-beam non-lethal laser weapon system for dazzling, flashblinding, illuminating or otherwise affecting an intended target subject. The system uses separate spaced-apart laser beams at close range, and uses the combined power densities of multiple overlapping beams at longer ranges to extend the effective range of the system. Generally speaking, the invention comprises a plurality of lasers that are rigidly mounted to a base that can be aimed by hand or by computer, remote and/or electronic control. The lasers include at least first and second lasers that are oriented to project respective laser beams generally along a first direction. Each of the first and second lasers diverge (i.e., grow in cross-sectional area) as they extend from the laser source, but are positioned so that they do not overlap one another until they reach a predetermined distance from the base. In the region before the laser beams overlap, they form two separate first-order illumination zones. In the region after the beams overlap, the overlapping beams form a combined second-order illumination zone. Preferably, the first and second beams are combined at the distance where the beam power density in the first-order illumination zones starts to become individually ineffective for providing the desired dazzling effects. By combining the two beams at this point, their cumulative power density increases, thereby extending the effective dazzling range of the laser. In various embodiments, the number of lasers can be increased, and they can be positioned or patterned to provide multiple subsequent combined illumination zones located at greater distances from the base. A more detailed description of the preferred embodiments is now provided in conjunction with the attached figures.

Figure 1:
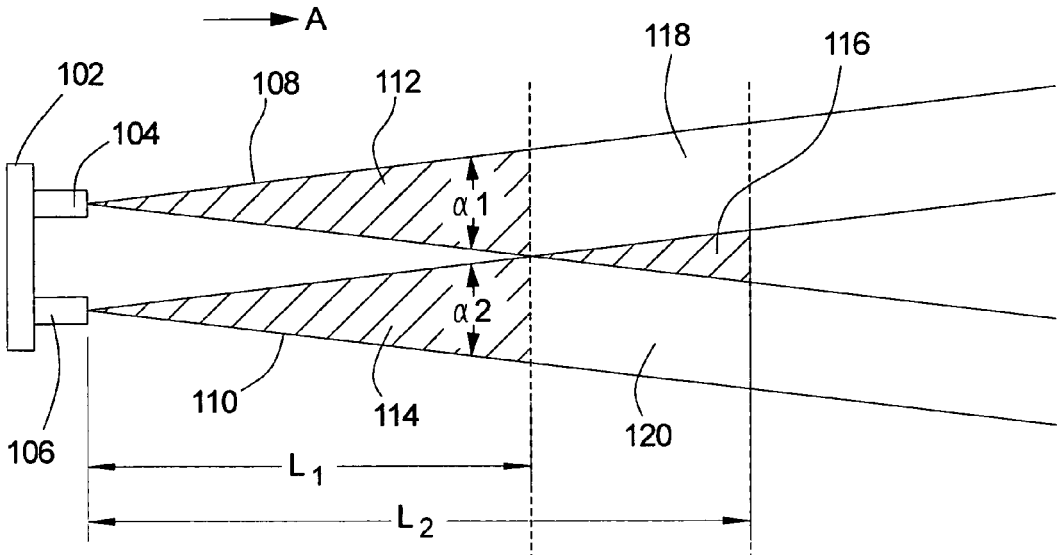
FIG. 1 is a side view of an embodiment of a two-laser system of the present invention showing first-order and second-order illumination patterns.

In a first embodiment of the invention, shown in FIG. 1, the device comprises a base 102 to which a first laser 104 and a second laser 106 are attached. The first and second lasers 104, 106 may be any type of laser having a wavelength in the visible spectrum of about 400 nm to about 700 nm, and preferably have a wavelength of about 532 nm (green light) or about 650 nm (red light). The first and second lasers 104, 106 are oriented to project a first laser beam 108 and a second laser beam 110, respectively, generally along a first direction, as shown by reference arrow A. Although the first and second laser beams 108, 110 may be parallel (as measured along their geometric central axes), they may also converge or diverge somewhat while still being oriented generally in the first direction. Such variations may result from manufacturing tolerances, or may be built into the device in order to obtain desirable beam overlapping characteristics, with divergence generally delaying beam overlap, and convergence generally advancing beam overlap.

The first and second lasers 104 and 106 are spaced from one another by distance y, and each of the laser beams 108, 110 diverges (i.e., grows in cross-sectional area) as a function of distance from the respective laser 104, 106. This divergence is shown by angle $\alpha 1$ for the first laser beam 108 and $\alpha 2$ for the second laser beam 110. (Note that the shapes of the beams 108, 110 are exaggerated in the Figures for clarity.)

The first and second laser beams 108, 110 extend separately from the base 102 for a first distance $L_1$, and overlap after the first distance $L_1$. It will be readily understood that the first distance $L_1$ can be calculated based on the value for the laser spacing y and the laser divergences $\alpha 1$ and $\alpha 2$. For example, when $\alpha 1$ and $\alpha 2$ are equal, the first distance $L_1$ can be calculated using the following simple trigonometric equation: $L_1=(y/2)(\text{cotan}(\alpha 1/2))$. Note that when the target is a human eye (which is generally the intended target of the invention), the target size is typically measured as having an aperture (pupil) size of about 7 millimeters, and therefore the actual effective location of first distance $L_1$ may be shortened due to the fact that the first and second laser beams 108, 110 may simultaneously encroach upon the retina, without overlapping, when the distance between the beams becomes 7 mm or less. Using the previous equation, the effective first distance $L_1'$ may optionally be calculated as: $L_1'=((y-7\text{ mm})/2)(\text{cotan}(\alpha 1/2))$. In one embodiment, it may be desirable to provide a minimum laser spacing of about 7 mm to prevent a single target from being exposed to multiple lasers at close range.

Somewhat more complex, but well understood, trigonometric equations and derivations thereof can be used to calculate the first distance $L_1$ when the lasers have different divergences or when they are offset relative to one another along direction A. Such calculations are well within the ordinary skill in the art. Of course, the first distance $L_1$ can also be determined using basic testing techniques, which are also within the ordinary skill in the art.

In the space between the base 102 and the first distance $L_1$, the first laser beam 108 provides a first first-order illumination zone 112, and the second laser beam 110 provides a second first-order illumination zone 114. The first and second first-order illumination zones 112, 114 are separate from one another, and targets located within either of the first-order illumination zones 112, 114 will be subjected to the energy of a single laser beam. The actual intensity of the laser beam striking the target depends on the target's distance from the laser and the laser's divergence and energy profile. For a continuous wave laser, the intensity I (which is typically measured in watts/cm$^2$ or milliwatts/cm$^2$) can be calculated by dividing the power rating by the area. For example, for an ideal laser operating continuously, having a conical divergence pattern and an even distribution of intensity throughout the beam (i.e., no "hot spots"), the intensity I is provided by the equation: $I=P/\pi(x\cdot\tan(\alpha/2))^2$; where P is the laser power (typically measured in watts), x is the distance from the laser, and $\alpha$ is the laser divergence. For pulsed lasers, which operate with a pulse duration and frequency, the intensity is also a function of the pulse rate and energy density (typically measured in Joules) per pulse, as will be understood by those of ordinary skill in the art.

At distances past the first distance $L_1$, the first and second laser beams 108, 110 combine to form a first second-order illumination zone 116. Of course, the uncombined portions 118, 120 of the first and second laser beams also continue to project away from the base 102, and may continue for some distance before their individual intensities drop below the threshold at which they produce the desired dazzling effect on the targets, as described in more detail with reference to FIGS. 3 and 4. Targets in the second-order illumination zone will be subjected to the combined intensities of the first and second laser beams 108, 110. By combining the laser beams 108, 110 in this manner, the effective range of the device can be extended, as now described with reference to FIG. 2.

Figure 2:
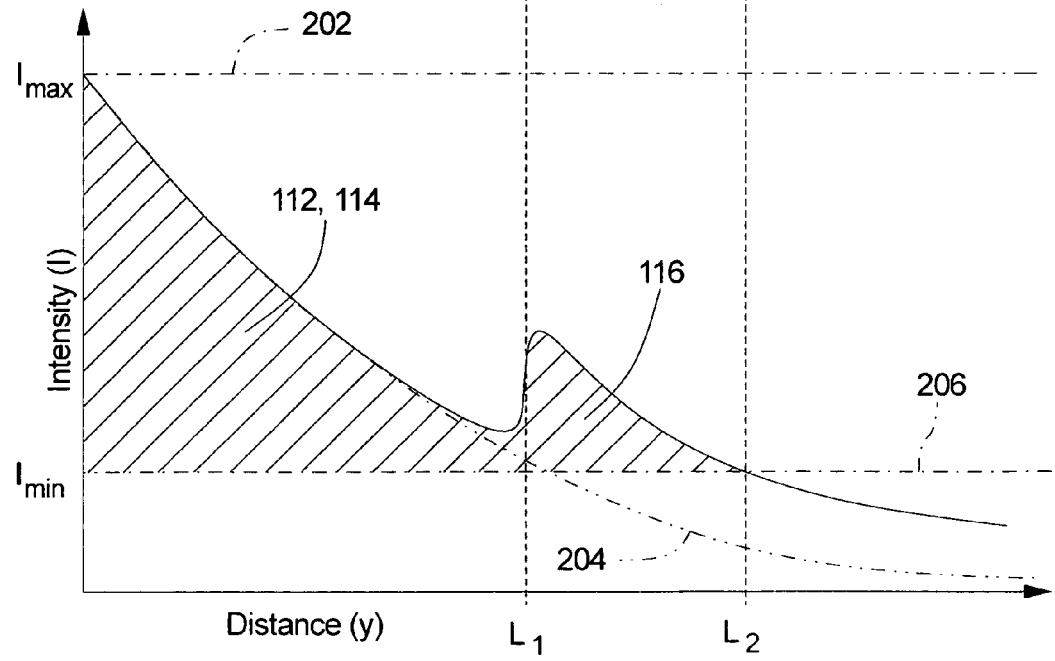
FIG. 2 is a representative laser intensity plot for the embodiment of FIG. 1.

FIG. 2 is a representative plot of the intensity, or power density, of the lasers projected by the device of FIG. 1 as a function of distance y from the base 102. For locations inside the first dimension $L_1$, the intensity is shown for a single first-order illumination zone because only one laser will strike any given target, such as a single human pupil, in this zone. For locations beyond the first dimension $L_1$, the intensity is shown for the second-order illumination zone 116. The maximum intensity $I_{max}$, generally occurs at the laser source, but may occur at the point where the laser beams overlap. As the distance y increases within the first-order illumination zone 112, the intensity decreases along a typical energy dissipation curve 204. At distance $L_1$, the two laser beams 108, 110 combine, doubling the intensity at the beginning of the second-order illumination zone 116. The combined intensity again drops off as a function of distance y, and eventually dissipates to zero.

Ideally, the intensity plot shown in FIG. 2 is tailored such that the maximum intensity $I_{max}$ does not exceed the Maximum Permissible Exposure (MPE) threshold, as set forth in, for example, the ANSI Z136.1-1993 guidelines, and representatively shown by line 202 in FIG. 2. Typical MPE values provided by ANSI and accepted by the U.S. Military include: 2.6 mW/cm$^2$ for a 0.250 second exposure to either 650 nm (red) or 532 nm (green) laser beams; 851 $\mu$W/cm$^2$ for a 20 second exposure to 650 nm (red) laser beams, and 500 $\mu$W/cm$^2$ for a 20 second exposure to 532 nm laser beams; and so on. Such standards are reproduced in Air Force Research Laboratory Report Number AFRL-HE-BR-TR-2001-0095. By so limiting the intensity, permanent eye damage can be avoided.

Although it is often preferred to impose the MPE limit on the present invention, it may be desirable to exceed the MPE under some circumstances, such as when the target poses a particularly high threat, or when it is highly unlikely that the target will be within the range in which the intensity levels exceed the MPE. One exemplary application where excessive intensity may be acceptable is when the device is mounted to a ship where the physical size and shape of the vessel may prevent the target from getting close enough to be exposed to the highest intensity levels.

It is also preferred that the intensity within the first-order illumination zone 112 does not drop below the minimum intensity $I_{min}$ required to provide the desired dazzling effects on the target. This threshold is depicted by line 206 in FIG. 2. As such, the first and second laser beams 108, 110 are selected, with respect to such factors as their wavelength, power, spacing and divergence, to begin to overlap at a distance where their individual intensities are still above the minimum effective dazzling intensity. The particular value for the minimum intensity $I_{min}$, will depend on the particular requirements of the user, and can be determined by routine testing programs, such as those described in Air Force Research Laboratory Report Number AFRL-HE-BR-TR-2001-0095. The maximum and minimum intensities can also be influenced by the laser frequency, whether different color lasers are used simultaneously, whether the lasers are pulsed or continuous wave, and by other factors that will be apparent to those of ordinary skill in the art with practice of the invention described herein.

When the first and second laser beams 108, 110 combine to form the second-order illumination zone 116, it is preferred that their combined intensity does not exceed either the MPE or any other desired maximum intensity $I_{max}$, although either condition may occur under some circumstances. This combined intensity is shown in FIG. 2 as a peak in the intensity plot at the first distance $L_1$. As noted before, the intensity in the second-order illumination zone 116 decreases as a function of distance y until it drops to zero. The point at which the intensity in the second-order illumination zone 116 drops to the desired minimum intensity $I_{min}$ required to obtain the desired dazzling effects is shown as distance $L_2$. This distance represents the extent of the device's dazzling effectiveness, although the device may still be useful as an area illuminator beyond this distance.

Figure 3:
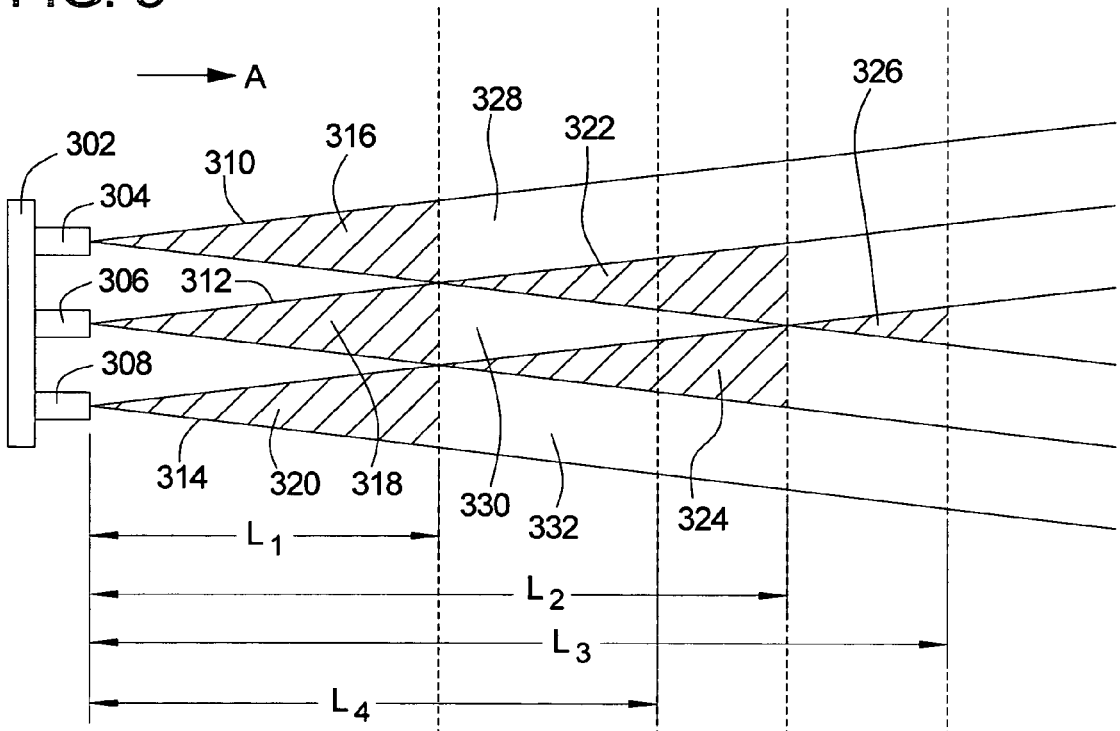
FIG. 3 is a side view of an embodiment of a linear three-laser system of the present invention showing first-order, second-order and third-order illumination patterns.
Figure 4:
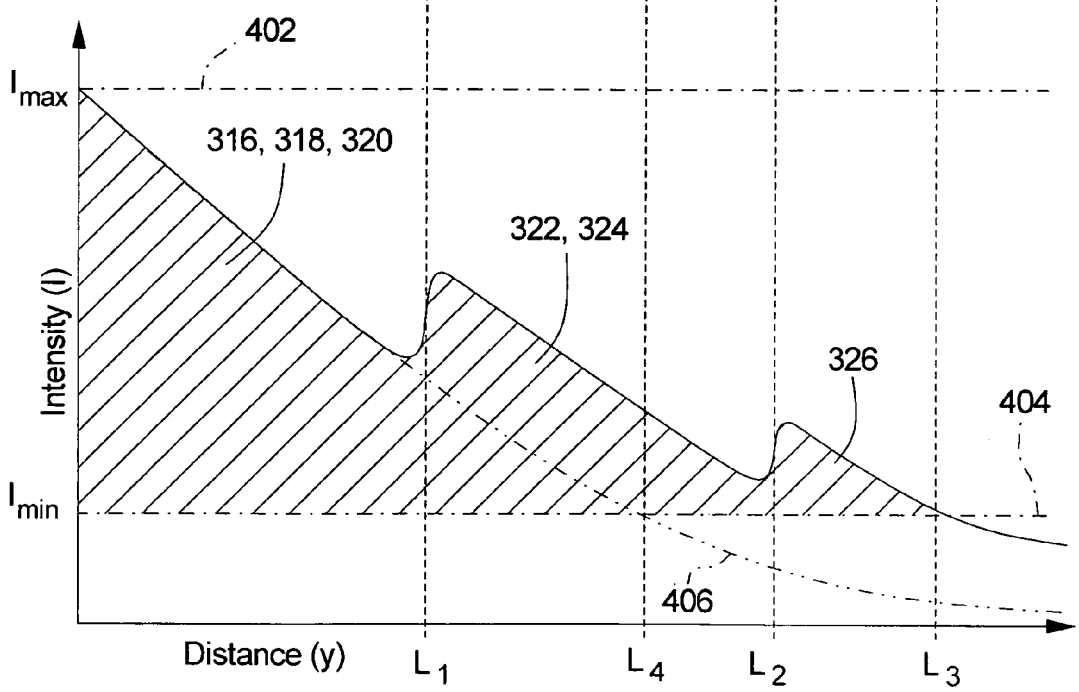
FIG. 4 is a representative laser intensity plot for the embodiment of FIG. 3.

Referring now to FIGS. 3 and 4, a three-laser embodiment of the invention will now be described. In this embodiment the device comprises a base 302 having a first laser 304, a second laser 306, and a third laser 308 mounted thereon. The first laser 304 is oriented to project a first laser beam 310 in a first direction, shown by reference arrow A, the second laser 306 is oriented to project a second laser beam 312 in the first direction, and the third laser 308 is oriented to project a third laser beam 314 in the first direction. As with the other embodiments, the laser's geometric axes may diverge or converge somewhat with respect to one another along the first direction A and still be considered to be oriented generally in that direction, and the degree of divergence or convergence may also be user adjustable. For clarity of explanation, the divergence angles of the three lasers are assumed to be identical and the lasers are all mounted in a line perpendicular to the direction in which they project. It will be understood that neither of these conditions is required, and the lasers may have different divergences and one or more lasers may be offset along direction A relative to the others, or spaced differently from the others along base 302.

The first laser beam 310 and second laser beam 312 overlap at a first distance $L_1$ from the base 302. Similarly, the third laser beam 314 and second laser beam 312 also overlap at the first distance $L_1$. In other embodiments, the second and third beams may instead overlap at a distance other than the first distance $L_1$. The first, second and third laser beams 310, 312, 314 provide first, second and third first-order illumination zones 316, 318, 320, respectively. Targets in each of these zones will be subjected to the energy of a single one of the laser beams 310, 312, 314. At distances beyond the first distance $L_1$, the combined first and second laser beams 310, 312 form a first second-order illumination zone 322, and the combined second and third laser beams 312, 314 form a second second-order illumination zone 324. Targets in either of the second-order illumination zones 322, 324 receive the combined intensity of two laser beams. The first- and second-order illumination zones described so far are similar to those described with reference to FIGS. 1 and 2.

The first, second and third laser beams 310, 312, 314 all combine into a single beam at a second distance $L_2$ from the base 302 to form a third-order illumination zone 326. Targets in the third-order illumination zone 326 will be subjected to the combined intensity of all three beams. As noted before, it may be desired to recalculate the exact length of the first distance $L_1$ and the second distance $L_2$ to account for the fact that the two or three beams may strike a common target, such as the typical 7 mm dilated pupil of a human target, before the beams actually overlap.

FIG. 4 shows the laser intensity of the embodiment of FIG. 3 as a function of distance. In this plot, the intensity in the first-order illumination zone 316, 318, 320 is represented by the energy of a single laser beam, the intensity in the second-order illumination zone 322, 324 is represented by the combined energy of two of the laser beams, and the intensity in the third-order illumination zone 326 is represented by the combined energy of all three beams. As with the embodiment of FIGS. 1 and 2, the maximum intensity $I_{max}$ may be selected such that it does not exceed the MPE, which is shown by line 402. It is also desirable that the second- and third-order illumination zones 322, 324, 326 begin before the intensity in the previous illumination zone drops below the minimum threshold value $I_{min}$ for providing the desired dazzling effects, as shown by line 404. The third-order illumination zone continues indefinitely, but effectively ends at a third distance $L_3$ from the base at which the combined intensity of the three beams drops below the dazzling threshold $I_{min}$.

Also shown in FIG. 4 is an energy dissipation curve 406 for the individual first, second and third laser beams 310, 312, 314. In this embodiment, the uncombined portions 328, 330, 332 of the first, second and third laser beams 310, 312, 314 continue to have enough intensity to provide the desired dazzling effects even after portions of the beams are combined to form the second-order illumination zones 322, 324. As such, the effective range of the individual laser beams continues to a fourth distance $L_4$ from the base 302.

In light of the foregoing disclosure, it should be noted that, as a rule, the terms "first-order illumination zone," "second-order illumination zone," "third-order illumination zone," and so on, are generally used for convenience in describing the geometry of the laser beams. Each illumination zone "order" ends at the point where the beam forming the zone combines with another beam to begin the next order illumination zone. These terms are generally not intended to describe the effective dazzling range of the lasers or the number of lasers that overlap therein. For example, the first-order illumination zones 316, 318, 320 of FIG. 3 terminate at the point where the beams overlap, not at the point where they become ineffective at dazzling the target, and the sixth-order illumination zone described with reference to FIGS. 6 and 10 has ten overlapping laser beams, rather than just six.

Figure 5:
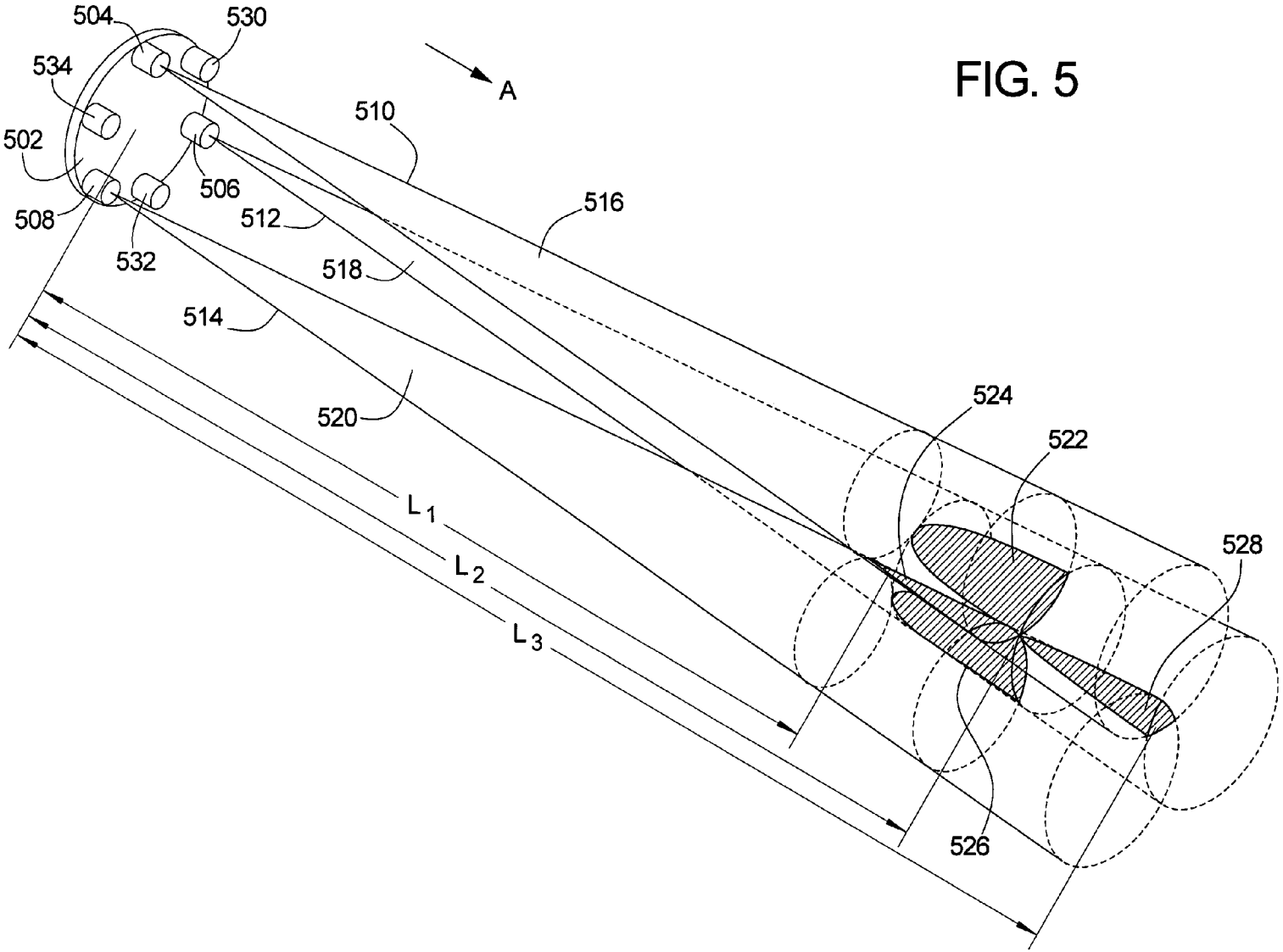
FIG. 5 is an isometric view of another embodiment of a three-laser system of the present invention with the second-order and third-order illumination patterns highlighted.

Another three-laser embodiment of the invention is shown in FIG. 5. This embodiment comprises a base 502 to which a first laser 504, a second laser 506, and a third laser 508 are attached in a triangular pattern. The lasers project respective first, second and third laser beams 510, 512, 514 generally along direction A. The triangular pattern of the lasers is shown as being an equilateral triangle, but isometric and other triangular shapes are also possible. It is also possible to offset one or more of the lasers relative to the others along the direction A or redirect one or more lasers to project its beam at an angle relative to direction A.

In the embodiment of FIG. 5, the first, second and third laser beams 510, 512, 514 each extend separately from the others for a first distance $L_1$ from the base 510 to thereby provide first, second and third first-order illumination zones 516, 518, 520, respectively. At the first distance $L_1$, the first laser beam 510 combines with the second laser beam 512 at one location and with the third laser beam 514 at another location to form separate first and second second-order illumination zones 522, 524. Also at the first distance $L_1$, the second and third laser beams 512, 514 combine to form a third second-order illumination zone 526. At a second distance $L_2$ from the base 502, all three laser beams 510, 512, 514 combine to form a third-order illumination zone 528. As with the embodiment of FIG. 3, targets in the first-order illumination zones 516, 518, 520 are subjected to the intensity of a single laser, targets in the second-order illumination zones 522, 524, 526 are subjected to the intensity of two lasers, and targets in the third-order illumination zone 528 receive the intensity of all three lasers.

As with other embodiments of the invention, the first and second distances $L_1$, $L_2$, can be readily calculated using fundamental trigonometric functions. Also, as with other embodiments having more than two lasers, the various illumination zones can offset relative to one another along direction A by changing the locations and/or divergences of one or more of the lasers.

The embodiment of FIG. 5 also depicts another feature of the present invention, which is the inclusion of multiple different sets of lasers in the device. In this embodiment, the first, second and third lasers 504, 506, 508 comprise a primary laser set, and base 502 also holds a secondary laser set comprising a fourth laser 530, a fifth laser 532, and a sixth laser 534. The lasers in the secondary laser set are shown deactivated, and so no laser beams are shown emitting therefrom. The secondary laser set may be activated simultaneously with the primary laser set to provide additional dazzling intensity, or may be activated as an alternative to the primary laser set to provide different intensity characteristics to account for changing circumstances. For example, in one embodiment, the primary laser set comprises green lasers (having a wavelength of about 532 nm) that are useful for daylight operation, and the secondary laser set comprises red lasers (having a wavelength of about 650 nm) for nocturnal operations. Alternatively, a primary laser set having green lasers could be used during both daylight and nocturnal operations, and a secondary laser set having red lasers could also be used nocturnally to overload night-vision devices that are sensitive to red light. The primary and secondary laser sets could also be alternatively flashed to enhance the dazzling effects of the device. Other uses will be readily apparent to those of ordinary skill in the art.

Figure 6:
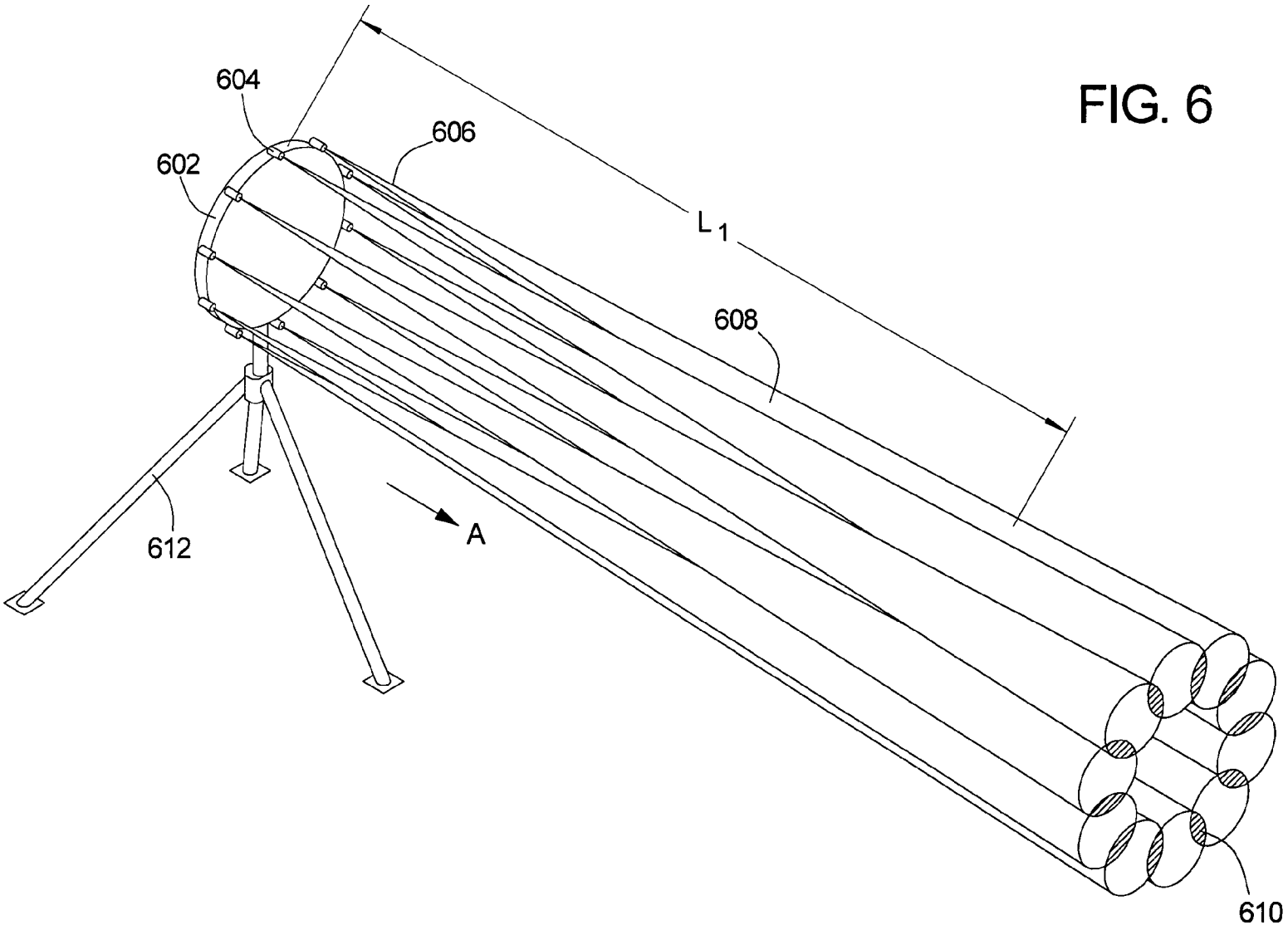
FIG. 6 is an isometric view of an embodiment of a ten-laser system of the present invention.

While the embodiments described previously herein each have two or three lasers, additional lasers can also be added. One such embodiment of the invention is shown in FIG. 6, in which ten lasers 604 are attached to a base 602 to project their beams 606 generally along direction A. The beams each progress separately for a first distance $L_1$ to thereby form ten different first-order illumination zones 608, then begin to combine to form a number of second-order illumination zones 610. As with the embodiment of FIG. 5, the lasers 604 may be separated into separate sets, each having one or more lasers, that are energized simultaneously or in patterns or sequences designed to enhance the dazzling effect. In the embodiment of FIG. 6, the base 602 is pivotally mounted to a mounting platform 612, which may be, for example, a portable collapsible tripod, a ship railing, a vehicle mount, a permanent building fixture, or the like.

Figure 7:
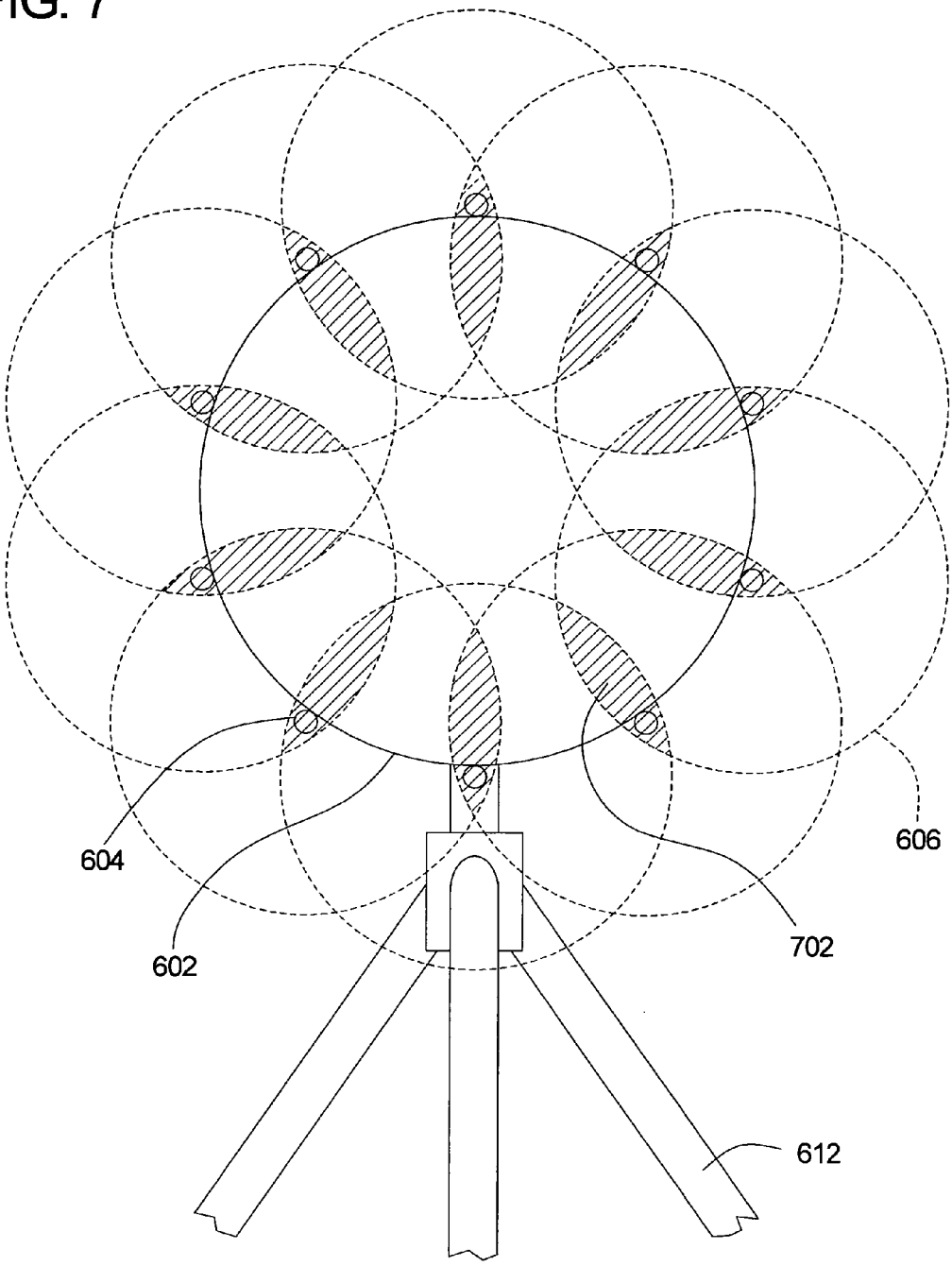
FIG. 7 is a third-order illumination pattern of the embodiment of FIG. 6.
Figure 8:
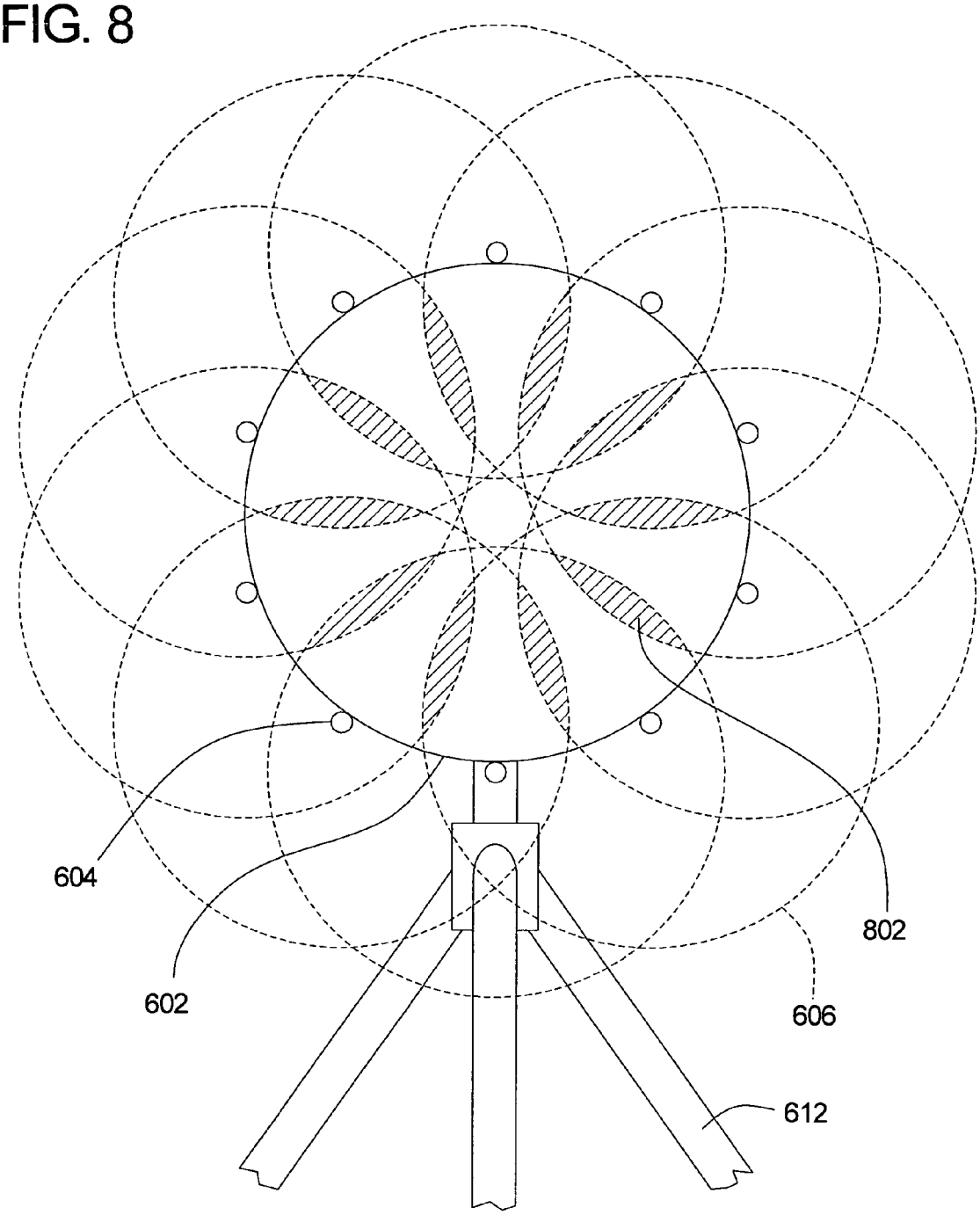
FIG. 8 is a fourth-order illumination pattern of the embodiment of FIG. 6.
Figure 9:
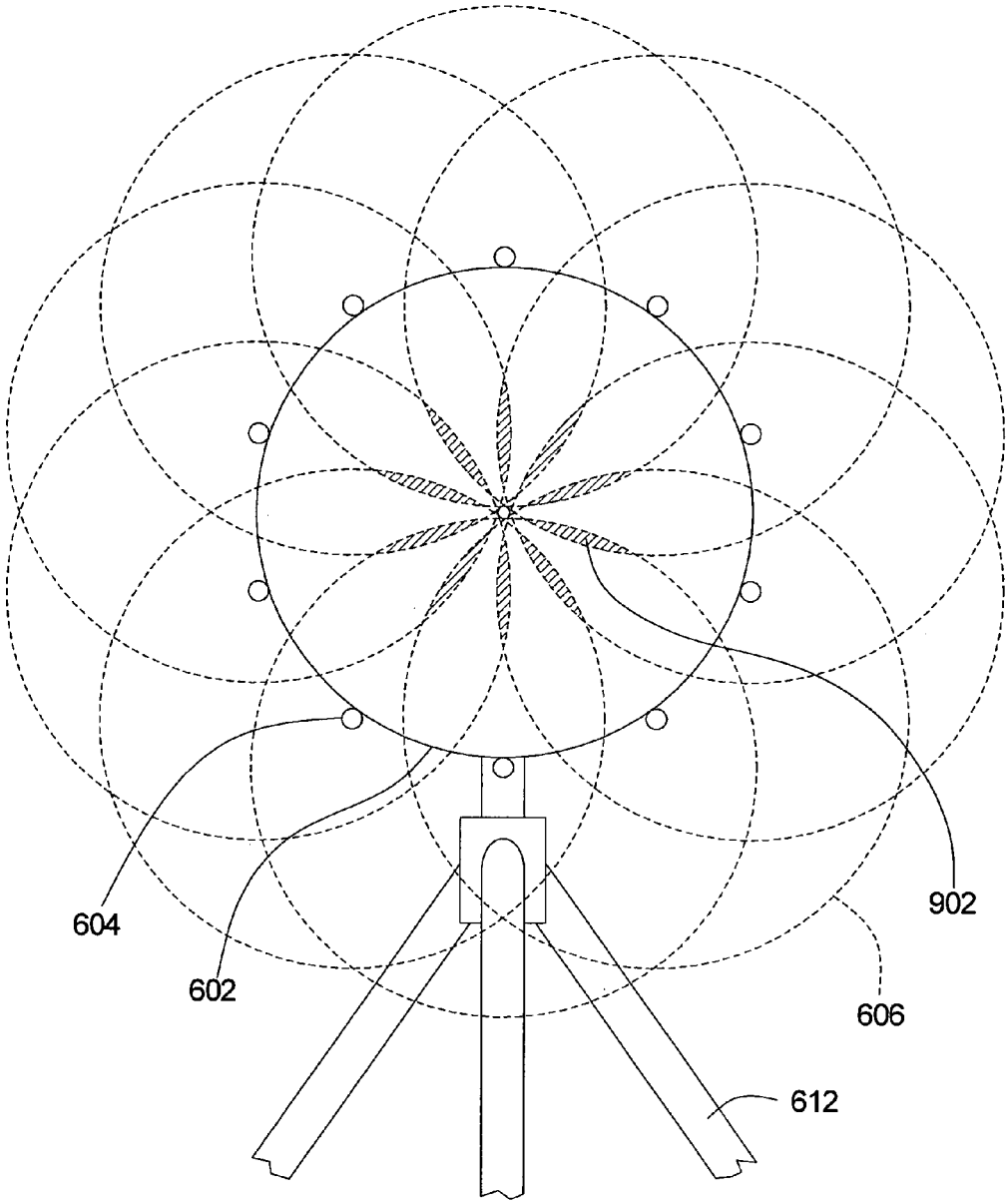
FIG. 9 is a fifth-order illumination pattern of the embodiment of FIG. 6.
Figure 10:
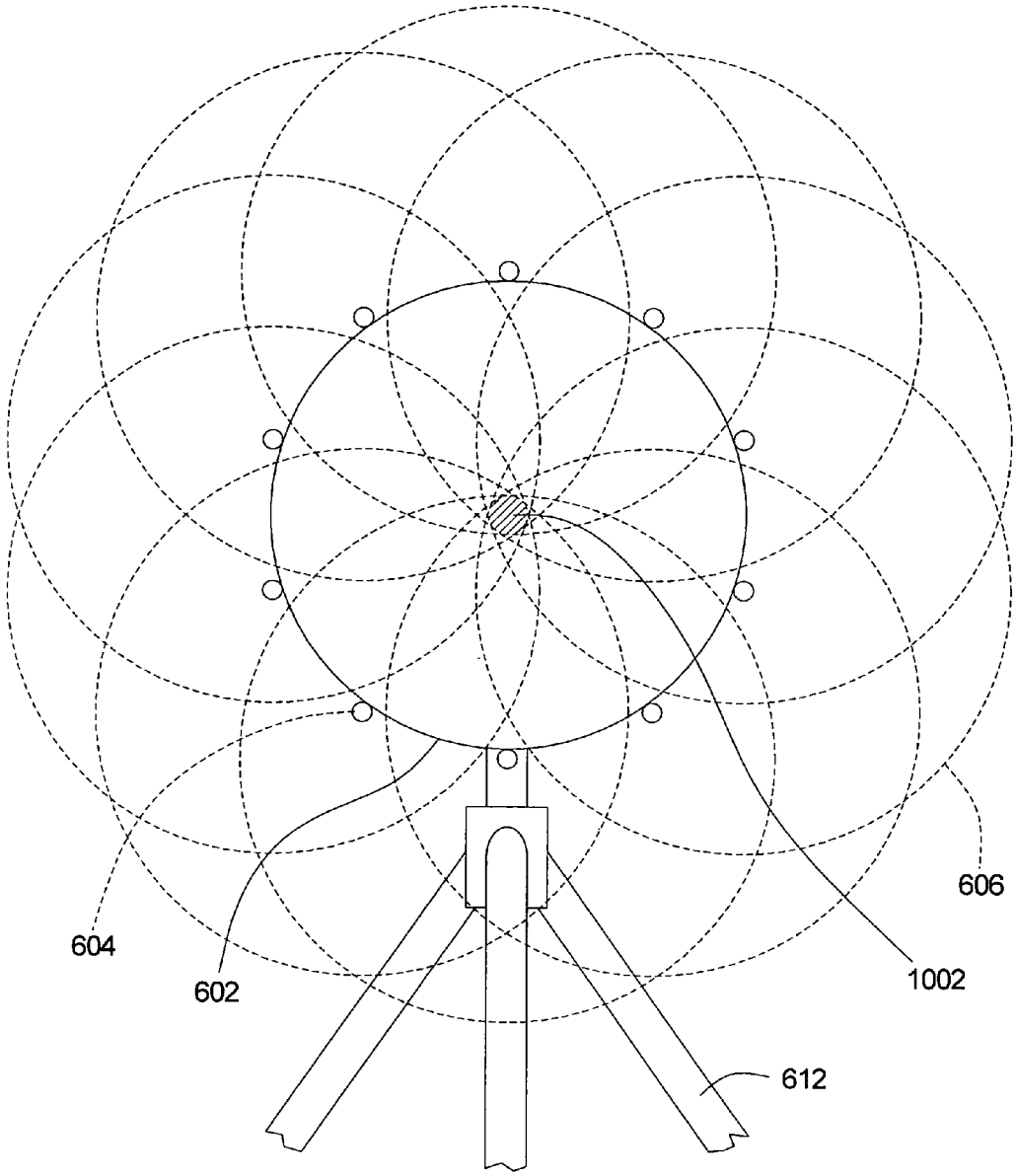
FIG. 10 is a sixth-order illumination pattern of the embodiment of FIG. 6.

FIGS. 7 through 10 are front views of the embodiment of FIG. 6, as shown at progressively greater distances from the base 602. FIG. 7 depicts the manner in which the laser beams 606 combine at a second distance $L_2$ to form a series of third-order illumination zones 702 at each location where three of the laser beams 606 overlap. Similarly, FIG. 8 depicts the manner in which the laser beams 606 combine at a third distance $L_3$ to form a series of fourth-order illumination zones 802 at each location where four of the laser beams 606 overlap, and FIG. 9 depicts the manner in which the laser beams 606 combine at a fourth distance $L_4$ to form a number of fifth-order illumination zones 902 where five laser beams 606 overlap. In the particular embodiment of FIG. 6 (in which ten lasers 604 are arranged in an evenly-spaced circular pattern), when the diameters of the laser beams 606 equal the distance between the lasers 604 on opposite sides of the circular array, all ten lasers 604 overlap at a fifth distance $L_5$ from the base 602 to form a single sixth-order illumination zone 1002, as shown in FIG. 10. Targets in the sixth-order illumination zone will be subjected to the intensity of all ten lasers.

As with other embodiments described herein, the various distances at which the illumination zones are formed can be calculated using basic trigonometric functions. For example, in the particular embodiment of FIG. 6, the following equations have been derived, using simple geometric functions, to provide the distances at which the various illumination zones begin:

$$L_1=0.156\cdot D\cdot\text{cotan}(\alpha/2);$$

$$L_2=0.294\cdot D\cdot\text{cotan}(\alpha/2);$$

$$L_3=0.405\cdot D\cdot\text{cotan}(\alpha/2);$$

$$L_4=0.476\cdot D\cdot\text{cotan}(\alpha/2);\text{ and}$$

$$L_5=0.500\cdot D\cdot\text{cotan}(\alpha/2);$$

wherein D is the diameter of the circular pattern of lasers 604 and a is the divergence angle of the lasers. Of course, other equations can be derived for other laser geometries.

Figure 11:
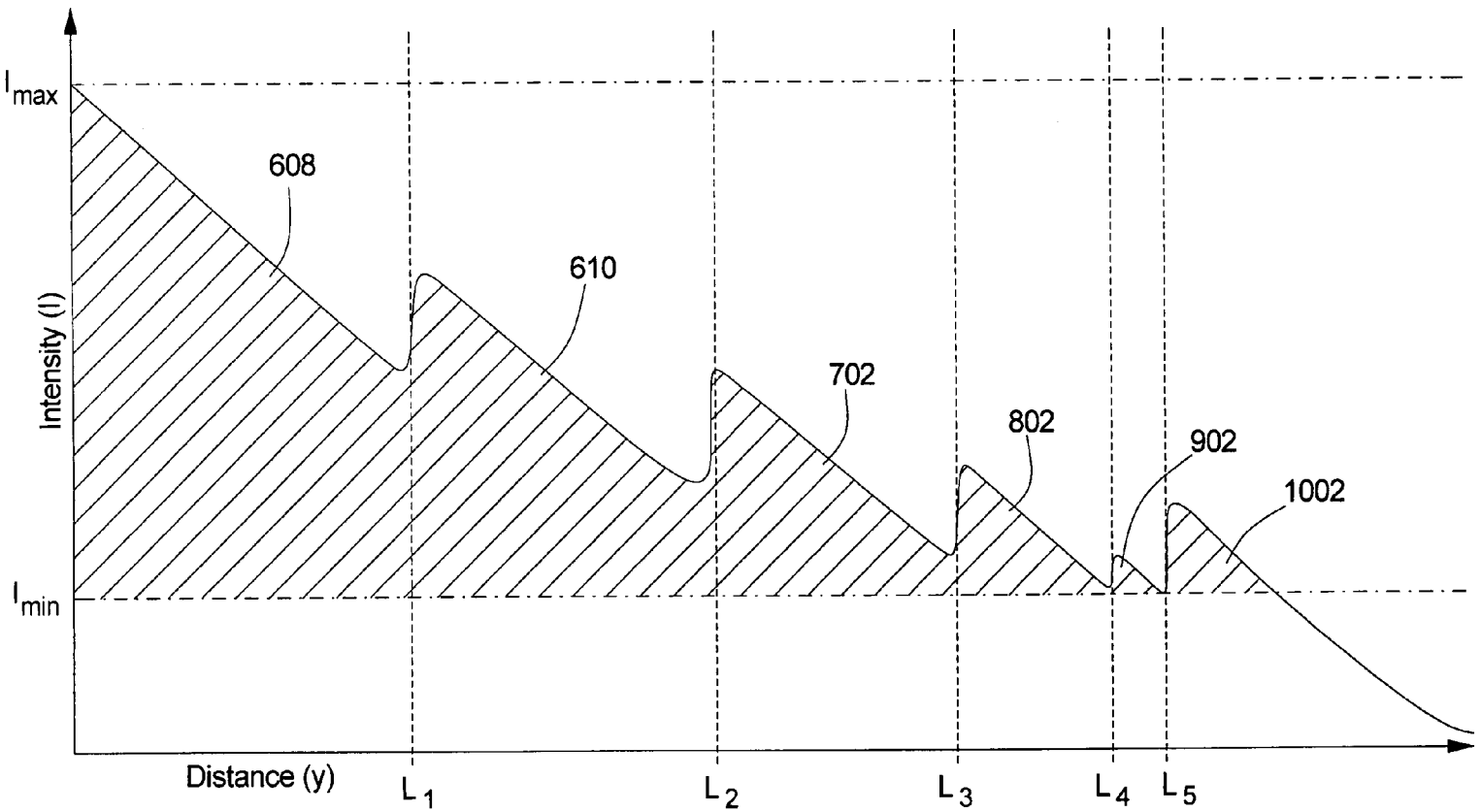
FIG. 11 is a representative laser intensity plot for the embodiment of FIG. 6.

The intensity of the embodiment of FIG. 6 as a function of distance y from the base 602 is representatively plotted in FIG. 11. As with the other embodiments, the maximum intensity $I_{max}$ preferably does not exceed the MPE value. It is also preferred that the intensities of the first-, second-, third-, fourth- and fifth-order illumination zones 608, 610, 702, 802, 902 do not drop below the minimum intensity $I_{min}$ for providing the desired dazzling effects, however some loss of effectiveness at particular ranges within each illumination zone may be present without departing from the scope of the invention.

The present invention can be used in various different configurations in addition to those described previously herein. Further examples of embodiments of the invention are shown in FIGS. 12 through 15.

Figure 12:
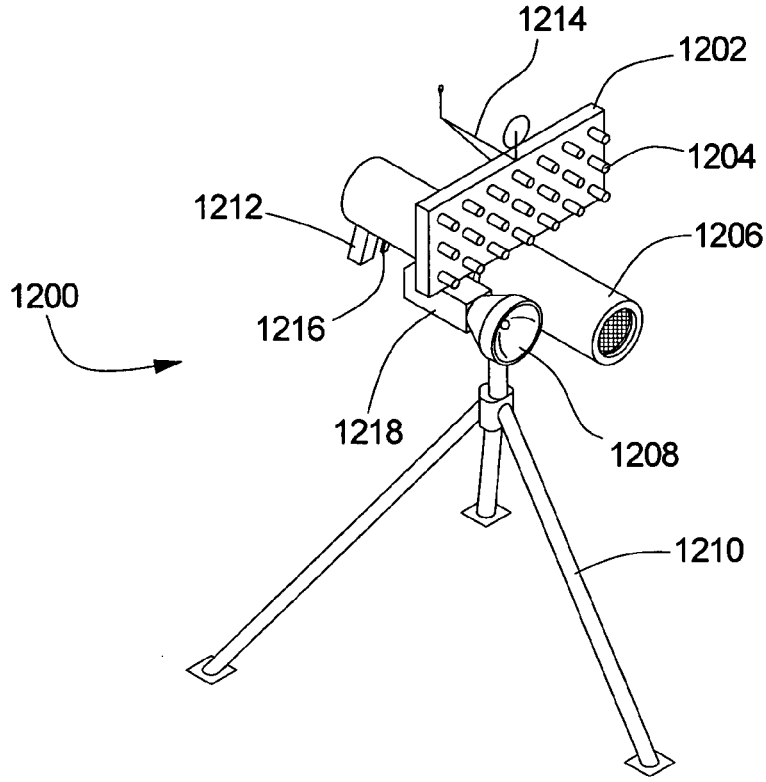
FIG. 12 is an embodiment of a pedestal-mounted laser system of the present invention.

FIG. 12 depicts an embodiment in which the present invention is integrated into a multifunctional deterrence device 1200. Device 1200 has a moveable base 1202 to which an array of lasers 1204, a high intensity directed acoustical device (HIDA) 1206 and a spotlight 1208 are mounted. The HIDA 1206 may comprise any device adapted to emit a high intensity acoustical wave that is useful for communicating with and/or stunning a target. Such devices are available, for example, from American Technology Corporation (San Diego, Calif.) under various trade names, including HIDA™ and LRAD™.

The base 1202 is pivotally mounted to a portable or fixed mounting platform 1210, such as by a common pintle mount, and the device can be aimed by hand by using one or more handles 1212. An optical sight 1214 may also be provided to assist with aiming. In this embodiment, the lasers 1204, HIDA 1206 and spotlight 1208 may be energized individually, together as a single group, or as multiple subgroups, by one or more control switches 1216. Control electronics, which are well known in the art, and a battery or connection to an external power source, are housed within a main electronics box 1218. Such an embodiment may be particularly useful as a multifunctional device for use on ships to deter other vessels from approaching the ship, or in other situations as will be apparent to those of ordinary skill in the art.

Figure 13:
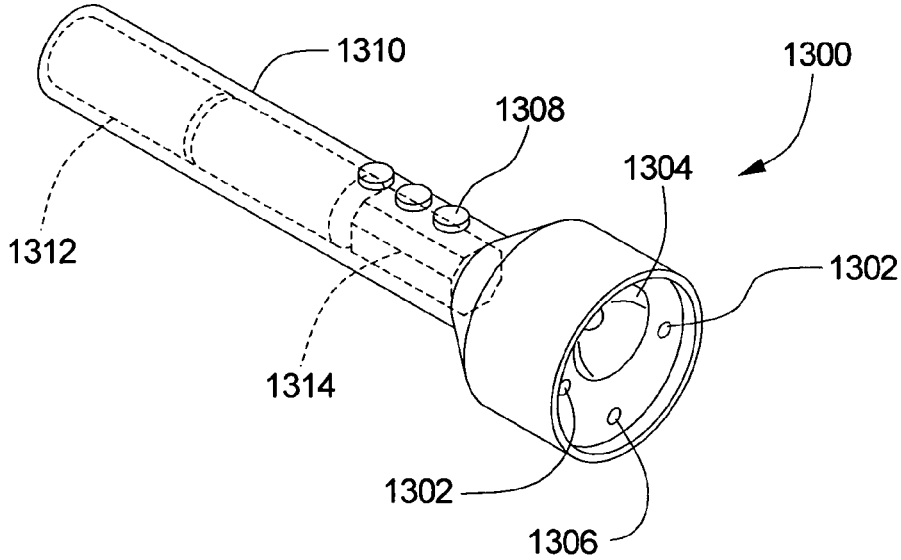

In another embodiment, shown in FIG. 13, the present invention is incorporated into a handheld flashlight-like device 1300. In this embodiment, two primary lasers 1302 are mounted to the base (the flashlight housing), along with a conventional incandescent flashlight 1304 and a relatively low-intensity targeting laser 1306, such as a class I laser. In this embodiment, the two primary lasers 1302 operate as described with reference to FIGS. 1 and 2. The targeting laser, which preferably does not significantly contribute to the laser dazzling effect provided by the device, can be energized to aim the device before activating the primary lasers 1302. The incandescent flashlight 1304 preferably can be operated separately from the lasers 1302, 1306 to provide the operator with a conventional flashlight illuminator. The incandescent flashlight 1304 also may be replaced by one or more light emitting diodes, laser diodes or conventional lasers that are adapted to provide a source of white light that is useful for illuminating areas in the manner of conventional flashlights. One example of a diode-based white light illuminating device is provided, for example, in U.S. Pat. No. 4,963,798 to McDermott, which is incorporated herein by reference.

The embodiment of FIG. 13 has a cylindrical body 1310 that houses one or more batteries 1312 that power the device 1300. The batteries 1312 are selectively connected to the primary lasers 1302, flashlight 1304 and targeting laser 1306 by a switch system comprising, in this case, three separate simple two-position switches 1308. Alternatively, a single or multiple multi-position switches may be used to operate all three devices individually or as groups. In either case, one or more of the switches 1308 may comprise a "momentary" switch that only activates the associated device when the switch is being depressed by the user, and automatically shuts off when not being depressed. For example, a single multi-position switch having an off position, a flashlight position, a target laser position, and a momentary primary laser position may be used to control all three devices. The switches may be toggle switches, pushbutton switches, rotary switches, or any other type of switch. The various electronic control circuits required to regulate the battery power to operate the lasers and incandescent lamp are also contained in the device 1300, preferably in a single integrated control unit 1314. The electronic controls required to operate the lasers used in the present invention are well known in the art and described, for example, in U.S. Pat. Nos. 6,142,650 and 6,431,732 to Brown et al, and U.S. Pat. No. 6,190,022 to Tocci et al., all of which are incorporated herein by reference.

The discussion provided herein has proceeded, solely for ease of explanation, on the assumption that the lasers are ideal lasers having a circular shape, a conical divergence pattern, and a uniform energy profile (such as a uniform "top hat" profile—so named for its resemblance to a top hat when the intensity is plotted across the laser's cross section). However, in practice, such lasers may not be available or may be prohibitively expensive, bulky or complex to use in some embodiments of the present invention. As such, lasers that do not have these ideal properties also may be used with the present invention, and some embodiments of the invention may even be adapted to take advantage of or minimize the non-ideal properties of such lasers. FIGS. 14 and 15 provide two examples of such embodiments.

FIG. 14 provides an embodiment of a hand-held portable laser dazzling device that uses an array of unmodified or slightly modified diode lasers to provide a broad field of effect. Semiconductor diode lasers, or diode lasers, are known to produce an astigmatic laser beam that is elongated in one dimension, as shown by the elliptical laser beams 1408, 1410, 1412 in FIG. 14.

Device 1400 comprises multiple sets of diode lasers that operate as pairs to create illumination zones spread across a wide distribution pattern. More specifically, the device 1400 includes a first pair of lasers 1402, a second pair of lasers 1404, and a third pair of lasers 1406. The first laser pair 1402, which is between the other pairs, is oriented to project its beams 1408 along a first direction as shown by reference arrow A. The other laser pairs 1404, 1406 are spaced away from the first pair 1402, and are oriented to project their beams 1410, 1412 either along the first direction A, or at angles that slightly diverge from the first direction, as shown in an exaggerated sense by reference arrows B and C, or at angles that converge with direction A.

The pattern of lasers shown in the embodiment of FIG. 14 creates a box-like array of first-order illumination zones that may help improve the device's area of effect. As the lasers project from the base (the device housing), the laser pairs 1402, 1404, 1406 join one another to form second-order illumination zones and other higher-order illumination zones. The manner and locations at which the lasers combine to form higher order illumination zones depend on the laser properties, locations, and the angles (if any) at which each laser pair is directed relative to the other pairs. Of course, any number of permutations are possible, and in various other embodiments, different numbers of pairs (and as few as one pair) of lasers may be used, the pairs may be rotated relative to one another, and one or both of the lasers that make up each pair may also be rotated at any angle to change the overall field of effect and to provide different patterns of first-order and higher order illumination zones.

It should also be noted that this box-like pattern of lasers can also be used with lasers having ideal circular shapes and uniform energy profiles. In such an embodiment the device would essentially comprise a combination of two two-laser devices, such as the one shown in FIG. 1, or a three-laser device, as shown in FIG. 5, having an additional laser added thereto.

It has also been recognized that some lasers have an irregular laser beam energy profile; meaning that the laser's energy is not distributed evenly throughout the beam's cross section. Such irregular profiles may be a result of the laser's inherent properties, such as in the case of laser diodes, or the result of imperfect attempts at using optics to modify the laser's shape. Irregular profiles are also caused by the laser having different transverse, electric and magnetic modes (commonly known as TEM(mn) modes) that provide different zero-intensity and low-intensity points distributed throughout the beam. For example, TEM(00) lasers have a regular Gaussian profile with a peak intensity in the center of the beam that tapers towards the edges, while TEM(01) lasers have a cold spot in the middle of the beam. In such cases, the laser has localized "hot spots" where the intensity is greater than average, and "cold spots" where the intensity is less than average. It has been suggested that the presence of hot and cold spots reduces the dazzling effectiveness of lasers, even when such lasers are perceived as being brighter than similar lasers having a uniform energy profile. By using multiple overlapping lasers as in the present invention, the effect of these hot and cold spots can be reduced by, for example, overlapping the hot spots of one laser with the cold spots of another, or by orienting the hot spots of a number of lasers into a useful dazzling central pattern and orienting the cold spots to provide ambient illumination.

As shown, using the present invention, irregularly-shaped laser beams and beams having irregular energy profiles can be used in conjunction with one another to improve the device's overall area of effect. The individual properties of each laser can be readily tested to determine its shape, divergence properties and energy profile, and these properties can be combined to provide a useful pattern of illumination zones. While such embodiments can avoid or reduce the use of optical systems that rearrange the laser's divergence pattern into a circular shape or a collimated shape—such as beam expanders, anamorphic prism pairs, fiber optics, cylindrical lenses, collimating lenses, power-changing positive and negative lenses, adjustable auxiliary lenses and the like—the present invention does not preclude the use of such devices, and these or other devices may be used to modify the lasers' properties in any embodiment of the invention. For example, FIG. 15 is an embodiment of the present invention in which the device 1500 comprises two lasers 1502, 1504 that are collimated using one or more lenses.

The device 1500 of FIG. 15 has two lasers 1502, 1504, each of which may comprise one or more diode lasers, gas lasers, or any other type of laser. Each laser 1502, 1504 is separately optically treated by a beam expander 1506, 1508 to shape the beam, improve the beam's energy profile uniformity, and collimate the beam. Such beam expanders are known in the art and described, for example, in U.S. Pat. Nos. 6,142,650 and 6,431,732 to Brown et al, and U.S. Pat. No. 6,190,022 to Tocci et al., all of which are incorporated herein by reference. The two collimated beams then project from the device housing 1510 (i.e., the base) to form two separate first-order illumination zones that eventually overlap to form a second-order illumination zone in the manner described herein with reference to FIGS. 1 and 2.

In the embodiment of FIG. 15, the device 1500 is powered by a remote power supply 1516 that contains one or more batteries and/or an electrical power outlet connection. Preferably, the remote power supply 1516 is a battery pack that having a belt clip 1518 or other means to conveniently carry the power supply 1516. The power supply also may have a hook or clip 1520 that is adapted to hold the device 1500 when it is not in use. One or more electrical wires 1528, which may be permanently wired or removable plug-in type wires, connect the power supply 1516 to the housing 1510. This remote power supply configuration can also be used in any other embodiment of the invention.

A single multi-position switch 1512 is provided on a handle portion 1514 of the housing 1510 to selectively energize one or both of the lasers 1502, 1504. The switch 1512 includes an off position 1522, a single laser position 1524, and a two-laser position 1526. When addressing nearby targets, the user can energize a single laser, and when addressing more distant targets, the user may selectively energize the second laser to increase the device' range by creating a second-order illumination zone. This configuration can help preserve battery life and reduce the possibility of harmful exposure to the lasers. Of course, other switching arrangements may be used, for example, a single switch may be used to simultaneously activate both lasers 1502, 1504, or multiple single-position switches may be used to separately energize the lasers 1502, 1504.

Various other embodiments of the invention are anticipated. For example, the present invention may include a stabilization control system, such as an inertial gyroscope, to help stabilize the device when aiming at a target. Such systems are also well known in the optical arts. It is also envisioned that the present invention may be used with remote control systems, in which the user identifies a target using a video monitor and directs the device to illuminate the desired target. In such a system, the user may operate the device's aiming controls, or may simply mark the intended target, such as by using a touchscreen on a video monitor, and let the electronic control system aim the device at the marked target. A fully automated electronic targeting system also may be adapted for use with the present invention. Such a system may comprise a computer-based system that is programmed to recognize human facial features and thereby accurately target the target's eyes, even at relatively great distances. Such an automated system may be useful as a remote sentry system to dazzle the target and give the impression that a human operator is present. Examples of facial recognition systems that may be integrated into the present invention are provided in U.S. Pat. No. 5,012,522 to Lambert and U.S. Pat. No. 6,430,307 to Souma et al., which are incorporated herein by reference.

In a most preferred embodiment of the invention, the lasers combine to form successive illumination zones that all provide the desired minimum dazzling intensity without exceeding the MPE or other upper threshold intensity at any location. However, when practicing some embodiments of the invention, it may be found that physical size restraints on the device, the availability or cost of materials, or other factors make it prohibitive to provide a seamless and continuous dazzling intensity at greater distances without exceeding the MPE (or other upper threshold) at closer distances or at some locations within the beams. In such cases, the device can be equipped with manually operated switches that can be used to de-energize a portion of the lasers to reduce the intensity when targets come within a predetermined distance. Alternatively, an automatic switching system employing a range finder (such as a laser, sonar or radar range finder, as are well known in the art) can be used to automatically disable some or all of the lasers when the target approaches or enters a location where the intensity exceeds the desired maximum value. Such a range finder may also be incorporated into the device to facilitate manual adjustment of the intensity.

Other variations on the present invention will be apparent to those of ordinary skill in the art in light of the present description of the invention, and after routine experimentation and practice of the invention. Non-limiting examples of various variables that may be experimented with include: the number, spacing, orientation and pattern of the lasers; the laser power, shape, energy profile, divergence and wavelength; the use of various groups of lasers; the separate and combined use of continuous wave and pulsed lasers; and so on.

While the present invention has been described and illustrated herein with reference to various preferred embodiments it should be understood that these embodiments are exemplary only, and the present invention is limited only by the following claims. Furthermore, to the extent that the features of the claims are subject to manufacturing variances or variances caused by other practical considerations, it will be understood that the present claims are intended to cover such variances.

I claim:

1. A non-lethal laser weapon comprising:

a base; and a plurality of lasers mounted to the base, the plurality of lasers comprising:

a first laser oriented to project a first laser beam in a first direction;

a second laser oriented to project a second laser beam generally in the first direction;

wherein the first laser beam and the second laser beam overlap at a first distance from the base, to thereby form separate first and second first-order illumination zones before the first distance, and a first second-order illumination zone beyond the first distance; and a high intensity directed acoustical device attached to the base and aimed generally parallel to the first direction.

2. The non-lethal laser weapon of claim 1, wherein at least one of the plurality of lasers has a wavelength of about 400 nm to about 700 nm.

3. The non-lethal laser weapon of claim 1, wherein at least one of the plurality of lasers has a wavelength of about 532 nm.

4. The non-lethal laser weapon of claim 1, wherein at least one of the plurality of lasers has a wavelength of about 650 nm.

5. The non-lethal laser weapon of claim 1, further comprising:

a power supply; and a power switch system connecting the power supply to the plurality of lasers and adapted to selectively energize the plurality of lasers.

6. The non-lethal laser weapon of claim 5, wherein:

the plurality of lasers comprises two or more laser groups, each of the two or more laser groups comprising one or more lasers; and the power switch system is adapted to selectively energize each of the two or more laser groups independently of the other laser groups.

7. The non-lethal laser weapon of claim 6, wherein the power switch system comprises a plurality of two-position switches, a plurality of multi-position switches, or a combination thereof.

8. The non-lethal laser weapon of claim 1, wherein the base comprises a portable hand-held device.

9. The non-lethal laser weapon of claim 1, wherein the base is movably mountable to a fixed or portable mounting platform.

10. The non-lethal laser weapon of claim 1, further comprising:

a third laser oriented to project a third laser beam generally in the first direction;

wherein the third laser beam overlaps the first laser beam at a second distance from the base and overlaps the first laser beam and the second laser beam at a third distance from the base, to thereby form a third first-order illumination zone before the second distance, a second second-order illumination zone between the second distance and the third distance, and a first third-order illumination zone beyond the third distance.

11. The non-lethal laser weapon of claim 10, wherein the first distance is equal to the second distance.

12. The non-lethal laser weapon of claim 10, wherein the third laser beam overlaps the second laser beam at the second distance from the base to thereby form a third second-order illumination zone between the second distance and the third distance.

13. The non-lethal laser weapon of claim 1, wherein the plurality of lasers comprises at least three lasers arranged in a linear pattern.

14. The non-lethal laser weapon of claim 1, wherein the plurality of lasers comprises at least three lasers arranged in a triangular pattern.

15. The non-lethal laser weapon of claim 1, wherein at least a portion of the plurality of lasers are arranged in a circular pattern.

16. The non-lethal laser weapon of claim 1, wherein the power supply is separated from the base and electrically connected to the base by one or more electrical wires.

17. The non-lethal laser weapon of claim 1, wherein one or more of the plurality of lasers comprises a separately collimated laser.

18. A hand-held non-lethal laser weapon comprising:

a base;

a plurality of lasers mounted to the base, the plurality of lasers comprising:

a first laser oriented to project a first laser beam in a first direction;

a second laser oriented to project a second laser beam generally in the first direction;

a power supply; and a power switch system connecting the power supply to the plurality of lasers and adapted to selectively energize the plurality of lasers;

wherein the first laser beam and the second laser beam overlap at a first distance from the base, to thereby form separate first and second first-order illumination zones before the first distance, and a first second-order illumination zone beyond the first distance; and a third laser oriented to project a third laser beam in a second direction; and a fourth laser oriented to project a fourth laser beam generally in the second direction;

wherein the third laser beam and the fourth laser beam overlap at a second distance from the base, to thereby form separate third and fourth first-order illumination zones before the second distance, and a second second-order illumination zone beyond the second distance; and wherein the second direction is not parallel with the first direction.

19. The non-lethal laser weapon of claim 18, wherein the power switch system comprises a plurality of switches, each of the switches being adapted to separately control one or more of the plurality of lasers.

20. The non-lethal laser weapon of claim 18, wherein the power supply is integrated into the base.

21. The non-lethal laser weapon of claim 18, further comprising a low-intensity targeting laser oriented to project a targeting beam in the first direction.

22. The non-lethal laser weapon of claim 18, further comprising an incandescent lamp oriented to project light in the first direction.

* * * * *